US006309299B1

(12) United States Patent
Weiss

(10) Patent No.: US 6,309,299 B1
(45) Date of Patent: Oct. 30, 2001

(54) GAMING DEVICE AND METHOD FOR INDIVIDUAL, HEAD TO HEAD AND TOURNAMENT PLAY

(75) Inventor: Steven A. Weiss, Las Vegas, NV (US)

(73) Assignee: Steve Weiss

( * ) Notice: Subject to any disclaimer, the term of this patent is extended or adjusted under 35 U.S.C. 154(b) by 0 days.

(21) Appl. No.: 09/395,449

(22) Filed: Sep. 13, 1999

(51) Int. Cl.[7] ..... A63F 13/00

(52) U.S. Cl. ..... 463/20; 463/16; 463/17; 463/18; 463/19; 463/21; 463/22; 463/23; 463/25; 463/26; 463/27; 273/138; 273/143; 273/85; 273/274; 273/237; 273/269

(58) Field of Search ..... 463/20, 16–19, 463/21–23, 25–27; 273/138, 143, 85, 274, 237, 269

(56) References Cited

U.S. PATENT DOCUMENTS

| | | | | |
|---|---|---|---|---|
| Re. 35,864 | | 7/1998 | Weingardt . | |
| 4,364,567 | * | 12/1982 | Goott | 273/237 |
| 4,760,527 | * | 7/1988 | Sidley | 364/412 |
| 4,836,546 | * | 6/1989 | DiRe et al. | 273/138 A |
| 4,995,610 | | 2/1991 | Paoletti . | |
| 5,083,800 | * | 1/1992 | Lockton | 273/439 |
| 5,192,076 | * | 3/1993 | Komori | 273/138 A |
| 5,324,035 | * | 6/1994 | Morris et al. | 273/138 A |
| 5,333,868 | * | 8/1994 | Goldfarb | 273/138 A |
| 5,393,057 | | 2/1995 | Marnell, II . | |
| 5,401,024 | * | 3/1995 | Simunek | 273/138 A |
| 5,611,730 | * | 3/1997 | Weiss | 463/20 |
| 5,651,735 | * | 7/1997 | Baba | 463/18 |
| 5,657,991 | * | 8/1997 | Camarato | 273/269 |
| 5,664,998 | * | 9/1997 | Seelig et al. | 463/20 |
| 5,762,552 | | 6/1998 | Vuong et al. . | |
| 5,769,714 | | 6/1998 | Wiener et al. . | |
| 5,797,794 | * | 8/1998 | Angell | 463/18 |
| 5,833,538 | * | 11/1998 | Weiss | 463/21 |
| 5,855,514 | | 1/1999 | Kamille . | |
| 5,909,875 | * | 6/1999 | Weingardt | 273/269 |
| 5,935,001 | * | 8/1999 | Baba | 463/18 |
| 6,077,162 | * | 6/2000 | Weiss | 463/26 |

* cited by examiner

*Primary Examiner*—Steven Wong
*Assistant Examiner*—Dolores R. Collins
(74) *Attorney, Agent, or Firm*—Bernhard Kreten

(57) ABSTRACT

A gaming device which allows individual play, head to head play and tournament play and involves the utilization of at least three chance means, including a plurality of reels, a video display configured as a matrix upon which scores can accumulate and icons located upon the grid itself provided for additional scoring.

21 Claims, 6 Drawing Sheets

GAMING DEVICE AND METHOD FOR INDIVIDUAL, HEAD TO HEAD AND TOURNAMENT PLAY

FIELD OF THE INVENTION

The instant invention is directed to instrumentalities and methodologies for wagering in a casino environment. More specifically, the instant invention is directed to a method and apparatus for playing a game that combines the pleasure of individual solitary play, enhanced by an election to compete with others.

BACKGROUND OF THE INVENTION

Faster, powerful, compact computers have allowed more dynamic games to be played in a casino environment. Although the potential now exists for more elaborate visual and auditory stimulus, by and large casino gaming devices have adhered to the traditional manifestations of slot machine depictions, such as spinning reels or the like.

While it is true that conventional manifestations maintain the familiarity that many players desire when selecting one of a plurality of machines, it is still desirable to elevate the awareness of patrons to richer visual depictions and auditory stimulus and at the same time introduce players to fresh games which are enjoyable, provide variety yet still adhere to a certain extent to the conventional perceptions of slot machines.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,995,610 | February 26, 1991 | Paoletti |
| 5,393,057 | February 28, 1995 | Marnell, II |
| 5,762,552 | June 9, 1998 | Vuong, et al. |
| 5,769,714 | June 23, 1998 | Wiener, et al. |
| Re. 35,864 | July 28, 1998 | Weingardt |
| 5,855,514 | January 5, 1999 | Kamille |

SUMMARY OF THE INVENTION

The instant invention benefits from the skillful blending of a traditional reel game with enhanced gaming devices that are intuitive to use and satisfying to play. In addition, the instant invention is versatile in its deployment in a casino environment.

A machine is provided which allows the game associated therewith to be used in a multiplicity of contexts. While conventional slot machines can be used for tournament play which monitors players' progress as a function of time allotted, initial credits deployed and the like, the instant invention allows for not only individual play, but tournament play as well as head to head competition with another.

At its fundamental level, the device according to the present invention is a conventional reel type slot machine, where the reels are preferably simulated on a video screen. The use of video depiction allows reconfiguration of the machine as a function of software protocol rather than the requirement that the machine be placed out of service temporarily while the physical trappings of the machine be revamped. The reels on the machine require a small area of the video screen and correlate to a visual depiction on a majority of the video display correlative of two other types of games. In one form of the invention, one game defines a grid having an abscissa and an ordinate provided with alpha numeric correlatives thereon. Superposed on this grid are a plurality of icons, preferably configured as various kinds of nautical vessels in general and military vessels in particular.

As the player plays the reel portion of the video display, certain symbols on the reels trigger ordnance mounted at a periphery of the grid. The ordnance may fire a single shot or a fusillade based on an outcome on the reels.

The ordnance can either hit the vessels located on the grid or land within sectors on the grid. Ordnance which lands within sectors on the grid collectively contribute towards an outcome in a manner correlative of keno. The sectors impacted by the ordnance are compared with a winning set of numbers in the determination of an award. In addition, however, all ordnance which strikes the vessels are tabulated and preferably periodically reported to the player for a further award of credits.

The system as just described lends itself to not only individual play, but also head to head competition in which two people playing on separate machines are linked in such a way that the flotilla that appears on one player's machine belongs to the player on the other machine and vise versa. In such a scenario, the relative head to head competition enhances the pleasure in playing the game and can generate an award to the victorious player.

In another form of the invention, many players compete in the manner of a tournament. Tournament winners can be determined by weighing nautical performance, keno results and reel outcomes all as a function of time played and credits aggregated.

OBJECTS OF THE INVENTION

Accordingly, it is a primary object of the present invention to provide a novel and useful gaming device and method.

A further object of the present invention is to provide that which has been characterized above which is intuitive to use and promulgates greater participation.

A further object of the present invention to provide that which has been characterized above which lends itself to ready deployment by a player individually, in head to head competition or in a tournament environment.

A further object of the present invention to provide that which has been characterized above which simulates themes that can be intuitively understood.

Viewed from a first vantage point, it is an object of the present invention to provide a gaming machine, comprising, in combination: means for displaying three distinct gaming propositions, and means for electing three types of player interaction.

Viewed from a second vantage point, it is an object of the present invention to provide a gaming method, including the steps of: initializing at least one machine, accepting a wager, electing group gaming or head to head competition in addition to individual gaming, enabling a first chance means, the first chance means triggering events in second and third chance means and rewarding outcomes of the chance means.

Viewed from a third vantage point, it is an object of the present invention to provide a gaming machine, comprising, in combination: a plurality of reels, means to actuate the reels, means responsive to displays on the plurality of reels to actuate a keno game and a nautical ordnance game.

DESCRIPTION OF PREFERRED EMBODIMENTS

Figure 1:
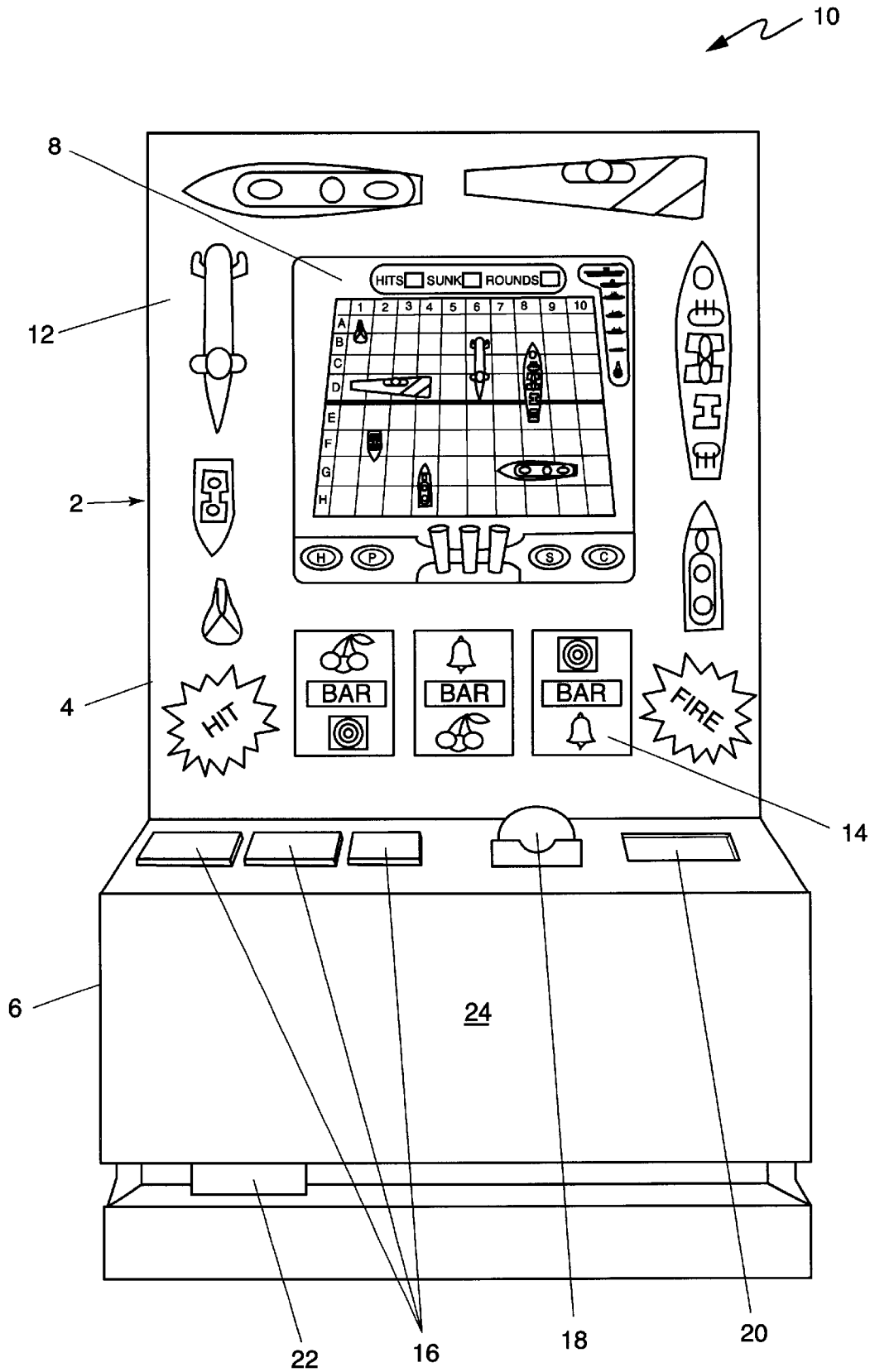
FIG. 1 is a front plan view of the machine according to the present invention.

Referring to the drawings, wherein like reference numerals denote like parts, reference numeral 10 is directed to the gaming machine according to the present invention.

The gaming machine includes a box type housing 2 having an upper portion 4 and a lower portion 6. The upper portion 4 includes an active video display 8 and a circumscribing periphery 12 with indicia thereon. The periphery 12 may also be integrated with and therefore define an active video screen. In addition, the upper portion 4 includes a reel assembly 14 (either mechanical or integrated with the video) whose values change and determine subsequent events on the video display 8.

The lower portion 6 includes a plurality of decision making buttons 16 that allow the player to manipulate the machine in accordance with machine protocol. For example, the buttons can enable a player to place a wager of minimal amount, maximum amount, direct the machine to cash out or the like. To be described with respect to FIG. 6, these buttons can be used in a bonus game. In addition, an input 18 allows coins, currency or card readers to be used therewith and a message panel 20 may be incorporated on the lower portion (or on the video display 8) to prompt the player with respect to certain opportunities or apprise of status. In addition, the lower portion 6 preferably includes a cash out dispenser 22 when the player decides to cease partaking of the game. The front panel 24 of the lower portion 6 may also include indicia thereon such as a pay table and other information.

Figure 2:
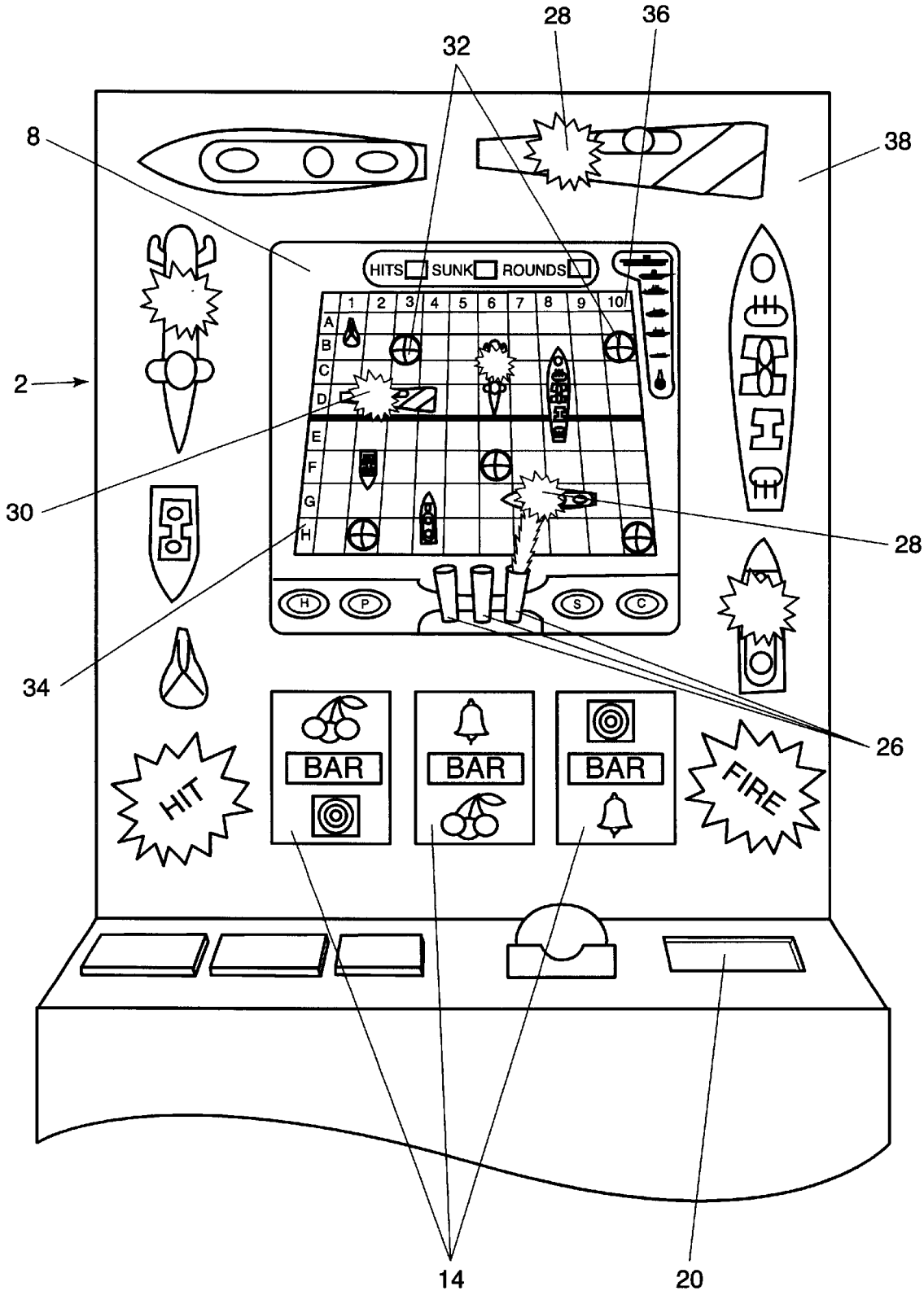
FIG. 2 is similar to FIG. 1 revealing a closer detail of the active playing area.

FIG. 2 shows the upper portion 4 during the course of play. As shown, the reels 14 have stopped at an orientation for illustrative purposes which is assumed to trigger events on the video display 8. The video display 8 includes a plurality of simulated artillery pieces 26 one of which in FIG. 2 is shown as launching a projectile 28. A "prior" projectile, i.e. one without a fresh "plume" of propulsion gases but with a "starburst" type impact 30 is shown in FIG. 2 as having landed earlier elsewhere on the video screen. In addition, prior artillery hits can be reflected by indicia markers 32 found on the screen.

The screen itself is configured as a matrix having an ordinate and an abscissa providing an alpha numeric depiction. Specifically, the ordinate 34 is shown as bearing an alphabetical sequence while the abscissa 36 bears a numerical sequence. Other Cartesian nomenclature can be used. For example, the figure depicts an 8 by 10 array. Each sector grid can be nominated in sequence one through eighty to correlate directly to a keno playing card.

Icons are provided on the video display 8 in various orientations and are replicated around the periphery of the video display for example on a "static" form of graphics, such as a display glass 38. Various icons which appear on the video display 8 and are replicated on the display glass 38 recap that the simulated ordnance projectile has landed on an icon within the video display 8. The nature of the hit is replicated by a "starburst" impact 30 shown on the display glass. Illumination (not shown) behind the screen preferably triggers this tell tale, or alternatively, the video display 8 can be dimensioned large enough so that the icons peripherally circumscribing the central playing area are also integrated within the video display field and reflect changes by receiving "starburst" type video graphics simulative of a hit. The lower left and right hand corners of the upper portion bear the legends "hit" and "fire" which correlate to the activities discussed with respect to the artillery pieces 26 having been fired and when a target has been hit. In addition, an audio simulation "tracks" the events by providing sound effects of bombs in flight and landing.

Assume that the icons on the display 8 did not receive ordnance as discussed so far. Any projectile which misses the icons instead lands into one sector grid defined by the abscissa and ordinate. Markers 32 reflect "misses" correlated to grid locations which form a further aspect of the game in that these grid locations define a "keno" type selection process preferably having a pay table reflected on the panel 24 which recognizes certain patterns of hits.

Figure 4:
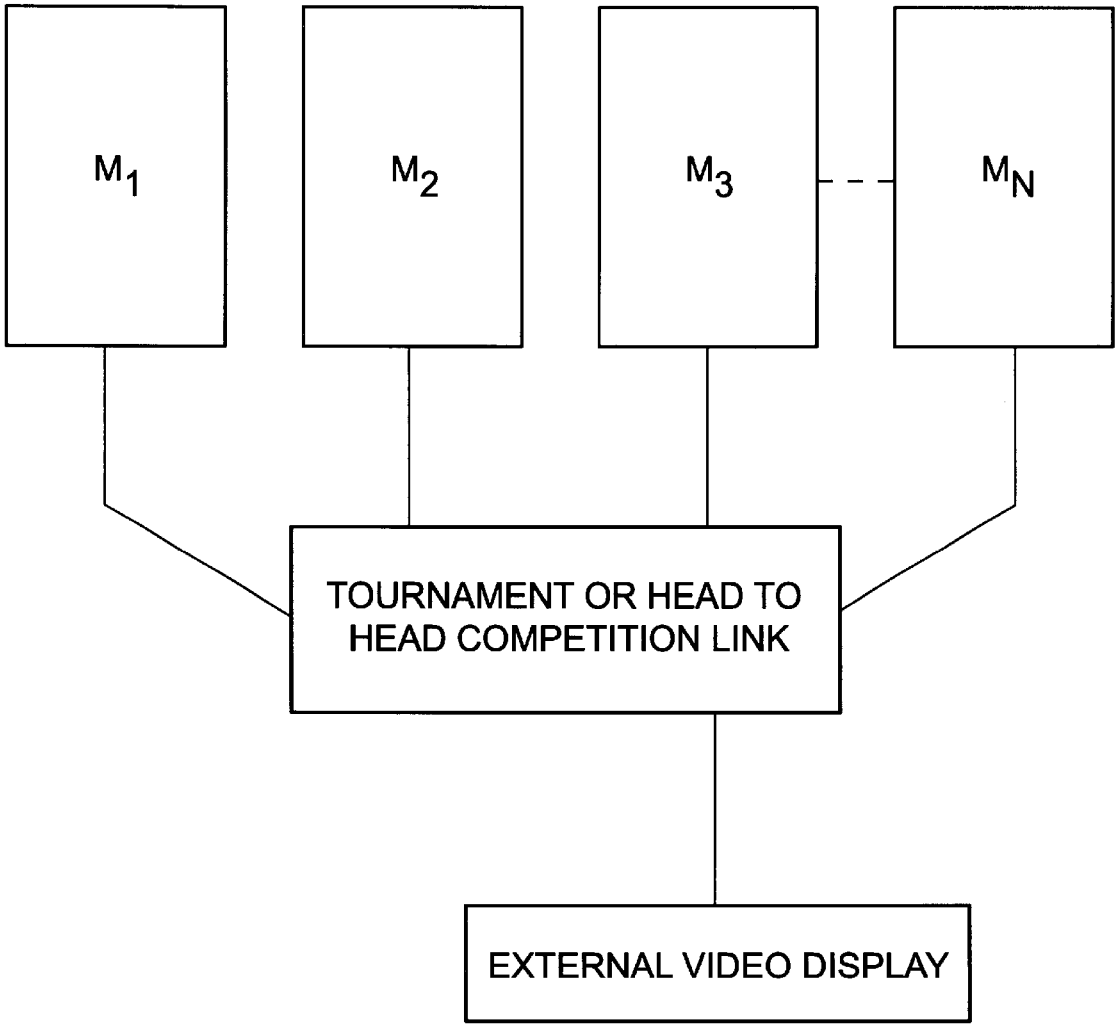
FIG. 4 illustrates a plurality of the machines shown in FIGS. 1 through 3 operatively coupled for head to head or tournament competition.

Alternatively, rather than compare the grid sectors which have been hit with a static pay table, the keno type pattern can be compared with an external video display to be discussed in conjunction with FIG. 4 so that players of the game can partake of keno which either has (rather than a static pay line as indicated on the panel 24) a dynamic component monitored via either the external display shown in FIG. 4 or perhaps transmitted to the message panel 20 discussed with respect to FIG. 1. "External" keno has particular utility when tournament play is engaged and can be correlated with preexisting casino keno which is typically available throughout the casino. When external keno is linked to these machines, the player's "selections" are dictated by where the ordnance falls on the grid and likely results in grid nomenclature paralleling keno nomenclature, as mentioned.

Figure 3:
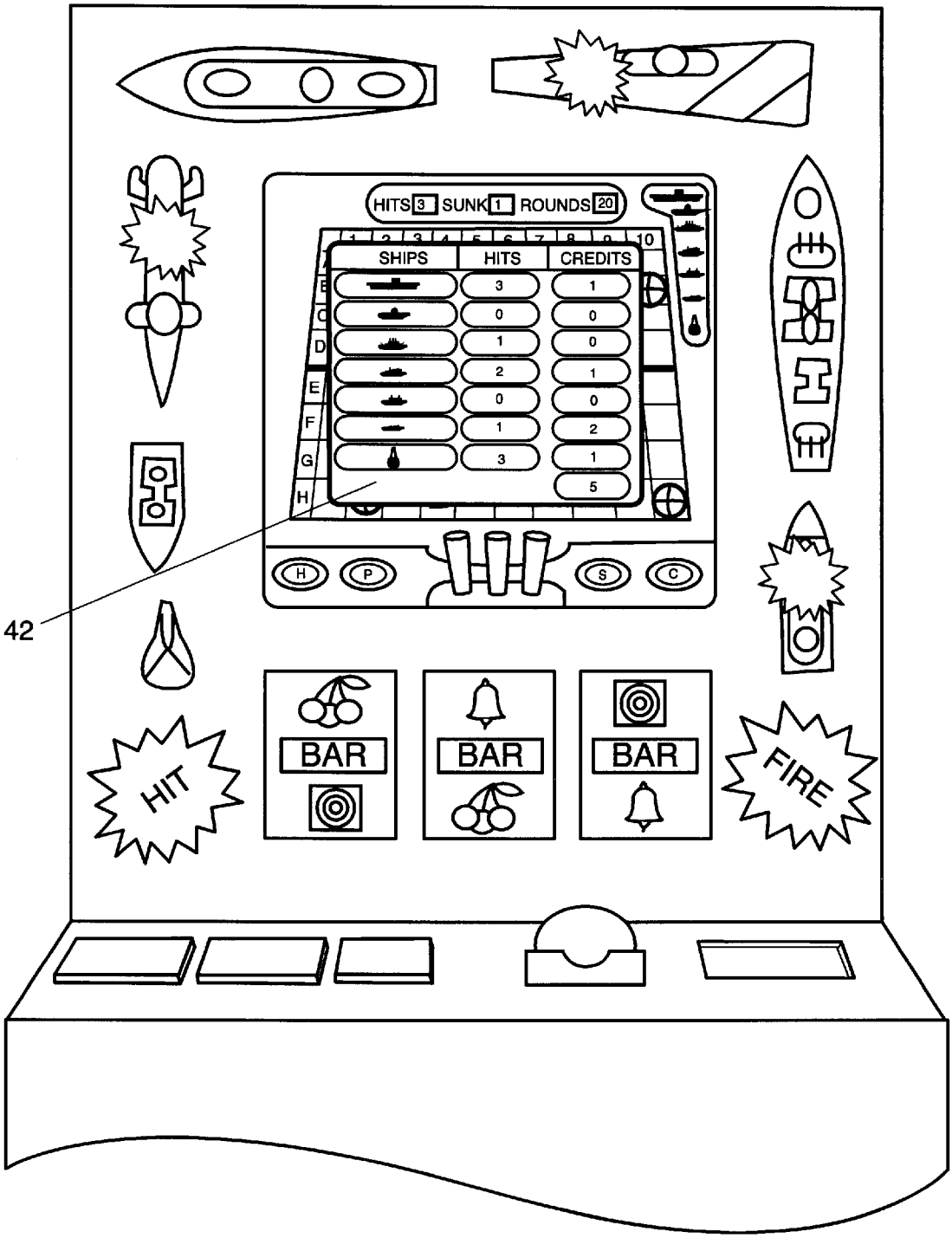
FIG. 3 shows a further phase of the FIG. 2 depiction.

Periodically, it is preferred that the player receive a further display such as that shown in FIG. 3. As depicted, the player's performance over a period of time is recapped and inventory is taken of the player's activities vis-à-vis the icons heretofore on the display screen and now replicated by way of a credit table 42 showing aggregation of hits corresponding to credits earned as the result of that activity.

As mentioned earlier, this invention has utility in both head to head competition and tournament play. In head to head competition, two players are pitted one against the other where the one player's icons (configured as nautical elements) are displayed on the other player's video display 8 and vise versa. Thus, each person's objective is to sink or destroy of much of the other person's nautical flotilla as possible.

In addition, the instant invention lends itself to having a multiplicity of machines (such as shown in FIG. 4) operatively interconnected for tournament play. A multiplicity of players compete in order to achieve a top award. Typically, the tournament play is initialized by having each player start with the same number of credits and/or allow each player to play for the same time interval such as fifteen minutes. At the termination of the contest, awards are due the participants based on their performance given certain criteria, such as progress on the machine, aggregate credits earned or the like. FIG. 4 reflects having a multiplicity of machines $M_1$, $M_2$, $M_3$ . . . $M_N$ all linked to a tournament or head to head competition processor which in turn is coupled to an external video display that allows the communal activity to post current standings. In addition, as mentioned above, the external video display shown in FIG. 4 can be used to generate or reflect keno numbers which compare with the progress one makes on the grid discussed above.

Figure 5:
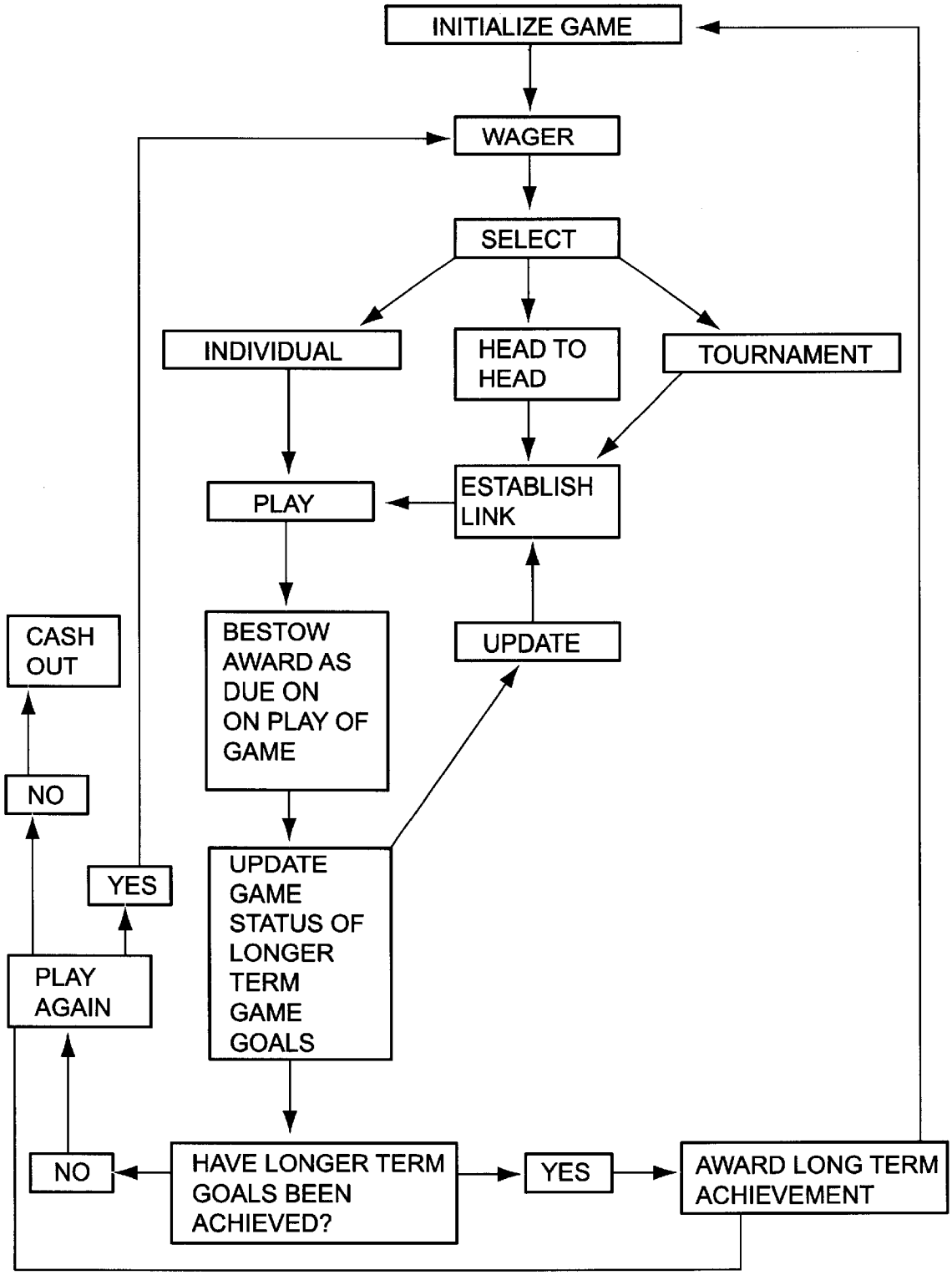
FIG. 5 is a flow chart of how an individual game can be utilized.

In use and operation, the game is initialized whereupon players are prompted to make a wager and thereafter select whether or not the ensuing activity is solely individual, head to head and/or tournament play as discussed above and seen in FIG. 5. Individual play allows the machine to stand alone except for the normal reporting requirements where the machine is linked to a centralized location. Head to head and tournament play requires the establishment of a communal link which is updated as a function of play. Once play has commenced, awards are bestowed as due on the play of the game and updates with respect to game status are reported to the link as is relevant for the longer term game goals inherent in head to head and tournament play. Once the longer term goals have been met, then an award is due based on that achievement. Should the longer term goals not have been elected earlier, in both cases the player is afforded the opportunity to play again as is shown in FIG. 5 by either engendering a wager alone, or an initialization and a wager together if the longer term goal is sought. Players ceasing to desire to play are allowed to cash out as shown in FIG. 5.

Figure 6:
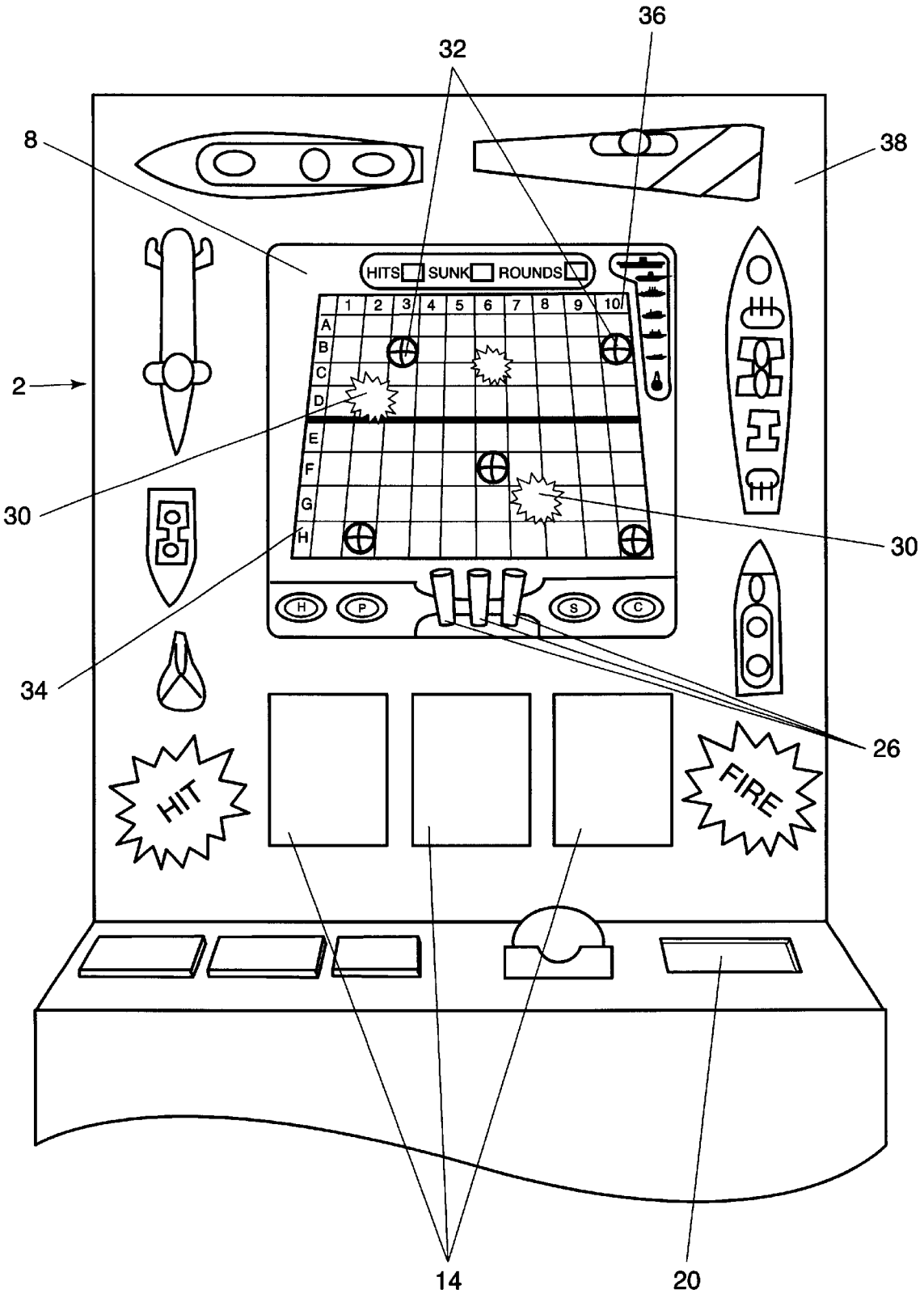
FIG. 6 is the front view of a medicine according to the present invention reflecting a bonus screen which periodically appears depicting a starburst impact.

FIG. 6 reflects a bonus screen which periodically appears preferably as a function of at least one outcome of reels 14. The sector-grid appears as before, but the nautical icons such as battleships, mine sweepers, aircraft carrier, buoys, P.T. boats are hidden from view. The player selects a sector to receive ordnance using either a touch screen or by manipulating the buttons 16. Should a nautical vessel be located at the chosen sector grid, a starburst impact 30 will occur. A miss would preferably appear as marker 32. Since the vessels have various dimensions, a number of proximate hits may be required to sink a vessel, particularly a large vessel like an aircraft carrier. The bonus round preferably limits the number of tries (shots) a player can take. After the bonus round, a recap such as seen in FIG. 3 is provided followed by an award.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming machine, comprising, in combination:

means for displaying three distinct gaming propositions including reels which control ordinance means, and means for electing three types of player interaction.

2. The machine of claim 1 wherein said displaying means includes plural sector grids each having an address location, some of said address locations having nautical icons thereon, means responsive to gaming machine outcomes for firing ordnance upon said sector grids, means for tabulating hits on said nautical icons, means for tabulating hits which miss said nautical icons, and means for awarding credits to a player as a function of said tabulating means.

3. The machine of claim 2 wherein said displaying means includes a plurality of reels which controls said means for firing ordnance, said ordnance firing means configured as artillery pieces located at a periphery of sector grids on said display means and operatively linked to indicia on said reels.

4. The machine of claim 3 wherein said nautical icons are visible during normal play.

5. A gaming method, including the steps of:

initializing at least one machine, accepting a wager, electing group gaming or head to head competition in addition to individual gaming, enabling a first chance means, said first chance means triggering events in second and third chance means and rewarding outcomes of said chance means, said chance means including or chance means.

6. A gaming machine, comprising, in combination:

a plurality of reels, means to actuate said reels, means responsive to displays on said plurality of reels to actuate a keno game having a kenotype and a nautical ordnance game having nautied icons.

7. A gaming machine, comprising, in combination:

means for displaying three distinct gaming propositions, and means for electing three types of player interaction, wherein said displaying means includes plural sector grids each having an address location, some of said address locations having nautical icons thereon, means responsive to gaming machine outcomes for firing ordnance upon said sector grids, means for tabulating hits on said nautical icons, means for tabulating hits which miss said nautical icons, and means for awarding credits to a player as a function of said tabulating means, wherein said displaying means includes a plurality of reels which controls means for firing ordnance, said ordnance firing means configured as artillery pieces located at a periphery of said sector grids on said display means and operatively linked to indicia on said reels.

8. A gaming machine, comprising, in combination:

means for displaying three distinct gaming propositions, and means for electing three types of player interaction, wherein said displaying means includes a plurality of reels which controls means for firing ordnance, said ordnance firing means configured as artillery pieces located at a periphery of sector grids on said display means and operatively linked to indicia on said reels.

9. A gaming machine, comprising, in combination:

means for displaying three distinct gaming propositions, and means for electing three types of player interaction, further including said displaying means includes plural nautical icons susceptible to hits or misses wherein said misses on said nautical icons correlates to a keno outcome.

10. A gaming machine, comprising, in combination:

a display including a plurality of reels, ordnance means for deploying said ordnance on said display, said plurality of reels controlling said ordnance means.

11. A gaming machine, comprising, in combination:

a display having plural nautical icons thereon, said nautical icons correlate to a keno outcome.

12. A gaming machine, comprising, in combination:

means for displaying three distinct gaming propositions, and means for electing three types of player interaction, said displaying means having a nautical theme including nautical icons located on a display and correlating to a keno outcome, means for firing ordnance, said display including a plurality of reels which controls said ordnance firing means.

13. The gaming machine of claim 1 wherein said three types of player interaction comprise:

tournament play;

head to head competition with another player;

or individual play.

14. The gaming machine of claim 1 wherein said three distinct gaming propositions comprises:

a first gaming proposition defined by a plurality of reels having a series of outcomes some of which bestow an award;

second and third gaming propositions defined by a display having at least a two dimensional Cartesian coordinate system upon which plural icons are to be contacted such that contact with said icons fulfills said second gaming proposition and failure to contact said icons fulfills said third gaming proposition.

15. The gaming machine of claim 6 wherein said keno game and said nautical ordnance game are simultaneously actuated whereby nautical ordnance misses constitute keno plays having a potential winning outcome.

16. The machine of claim 7 wherein said nautical icons are obscured during bonus play and a player controls sector grid ordnance firing.

17. The machine of claim 16 wherein the player is allotted a predetermined number of ordnance during bonus play.

18. The machine of claim 17 wherein said displaying means further includes plural nautical icons susceptible to hits or misses wherein said misses on said nautical icons correlates to a keno outcome.

19. The machine of claim 18 wherein said electing means enables solitary play.

20. The machine of claim 19 wherein said electing means enables head to head play.

21. The machine of claim 20 wherein said electing means enables tournament play.

* * * * *